US005861840A

United States Patent [19]

Tarran et al.

[11] Patent Number: 5,861,840

[45] Date of Patent: Jan. 19, 1999

[54] TELECOMMUNICATIONS ANTENNA

[75] Inventors: Christopher John Tarran; Albert Kester Roberts, both of Hampshire; Peter John Wright, Wiltshire; Charles Ralph Green, Hampshire, all of England

[73] Assignee: Roke Manor Research Limited, Romsey, United Kingdom

[21] Appl. No.: 726,665

[22] Filed: Oct. 7, 1996

[30] Foreign Application Priority Data

Oct. 6, 1995 [GB] United Kingdom ..... 9520434

[51] Int. Cl.[6] ..... H01Q 3/22; H01Q 21/06

[52] U.S. Cl. ..... 342/371; 342/361

[58] Field of Search ..... 342/368, 371, 342/372, 374, 361

[56] References Cited

U.S. PATENT DOCUMENTS

| | | | |
|---|---|---|---|
| 3,854,140 | 12/1974 | Ranghelli et al. | 342/361 |
| 4,124,852 | 11/1978 | Steudel . | |
| 4,370,012 | 1/1983 | Bevan et al. . | |
| 5,038,147 | 8/1991 | Cerro et al. | 342/368 |
| 5,173,711 | 12/1992 | Takeuchi et al. | 343/700 MS |
| 5,243,354 | 9/1993 | Stern et al. . | |
| 5,247,269 | 9/1993 | Boulouard et al. | 333/126 |
| 5,686,926 | 11/1997 | Kijima et al. | 342/373 |

FOREIGN PATENT DOCUMENTS

| | | |
|---|---|---|
| 0 600 699 A1 | 6/1994 | European Pat. Off. . |
| 2 150 793 | 7/1985 | United Kingdom . |
| 2 232 536 | 12/1990 | United Kingdom . |

*Primary Examiner*—Gregory C. Issing
*Attorney, Agent, or Firm*—Hill & Simpson

[57] ABSTRACT

An antenna system is comprised of a plurality of independently constructed and operated antenna units, upon which are mounted a plurality of transmit and receive antenna pairs. This structure provides a means for the antenna system to be arranged to provide substantially hemispherical radio coverage. By adjusting the phase of each version of a radio signal to the transmitter or received, the signal may be formed into a beam according to known techniques of directional beam forming providing the antenna system with directional gain. Additionally, using a plurality of transmit and receive antenna pairs reduces the energy transmitted by each transmit antenna alone to a level which permits a branch line coupler to be sufficient to orthogonally polarize the transmitted and received radio signals negating the requirement for the duplexing filter for duplex operation.

21 Claims, 6 Drawing Sheets

TELECOMMUNICATIONS ANTENNA

BACKGROUND OF THE INVENTION

1. Field of the Invention

The present invention relates generally to the field of antennas and, more particularly, the present invention relates to improved radio telecommunication antennas.

2. Description of the Related Art

Information is communicated in radio communication systems through the transmission and reception of electromagnetic waves. Data to be communicated modulates an electromagnetic wave at a transmitter which produces signals that are radiated by an antenna. An antenna at a receiver detects the electromagnetic wave which is demodulated by the receiver, thereby reproducing the transmitted data. Electromagnetic waves containing data which are used for communication in this manner are known as radio signals. Antennas which are used in transmitting and receiving the electromagnetic signals provide gain to both transmitted and received radio signals.

In areas of radio communications such as satellite communications, the direction in which radio signals are transmitted and received is important. In satellite communications, radio signals must travel over large distances through a variety of unknown media. This results in a significant decrease in the power of the transmitted radio signal which ultimately reaches the receiver. In order to form an effective radio communication link, optimum use must be made of the transmitted and received radio signal power. For this reason, radio telecommunication systems often use antenna systems which maximize the gain of a radio signal transmitted in or received from a given direction.

An antenna system which is known in the art that operates to utilize the direction of transmission or reception of a radio signal is a planar phased array antenna. Such a planar phased array is comprised of a plurality of antennas arranged on a plane surface. Each antenna may transmit or receive a version of the radio signal. In the case of reception, for example, each antenna of the planar phased array delivers a version of the radio signal, although shifted in phase in accordance with the spatial separation of each antenna relative to the direction of arrival. A schematic diagram of such a planar phased array in which three antennas are incorporated is set forth in FIG. 1.

In FIG. 1, a planar phased array 1 is shown which is comprised of three antennas 2, 3, 4. Radio waves transmitted by a distant source (not shown) are received by the three antennas 2, 3, 4. Three versions of the received signal 5, 6, 7 are delivered by the three antennas 2, 3, 4. As a result of the spatial separation of the antennas, the received signals are displaced in time with respect to each other, resulting in the three versions of the received signal exhibiting a phase displacement in correspondence with the spatial separation of each antenna. Let $r_x(t)$ be the signal received by an antenna x at a time t, where, in this case x=1 to 3 for the three antennas 2, 3, 4. If the version of the signal received by the first antenna is given by equation (1), then the versions of the signal received by the second and third antennas 3, 4, will be those given by equations (2) and (3), where $R_x$ is the power in each version of the signal. Each version of the signal is then combined by a summer 8, to produce a resultant signal r(t). The combined received signal is represented by equation (4).

$$r_1(t) = R_1 e^{j\omega t} \tag{1}$$

$$r_2(t) = R_2 e^{j\omega(t+\Delta T)} \tag{2}$$

$$r_3(t) = R_3 e^{j\omega(t+2\Delta T)} \tag{3}$$

$$r(t) = \sum_{x=1}^{3} r_x(t) = (R_1 + R_2 e^{j\omega\Delta T} + R_3 e^{j\omega 2\Delta T}) e^{j\omega T} \tag{4}$$

As illustrated in FIG. 1, the planar phased array, is less suitable for detecting a radio signal 9, which has an angle of incidence which is greater than sixty degrees from the perpendicular 10. This will be discussed below.

A conventional planar phased array is mechanically steered to a desired direction in which the reception of a radio signal is optimized. The optimum direction of reception or transmission is that which causes the phase of each version of the signal to be the same. The phased array therefore operates so that the versions of the radio signal add constructively. As can be seen from the example in FIG. 1, this is achieved by steering the array until the axis upon which the antennas are mounted is perpendicular to the direction of propagation of the signal to be received. This causes the relative delays between each version of the received signal to be reduced to zero, resulting in no corresponding phase displacement. The signals therefore add constructively. Likewise a radio signal may be transmitted in a desired direction, by steering a corresponding phased array so that it points accordingly in a desired direction.

A known technique in which radio signals may be transmitted in, or received from a direction by an array of spatially displaced antennas, which does not involve mechanical movement of those antennas, is known as electronic beam steering. With this technique, the phase of each version of the radio signal is arranged to be shifted electronically, so that the versions of a radio signal add constructively for transmission or reception in a desired direction. The versions of the radio signal are therefore focussed into a beam pointing in the direction of transmission or reception. The direction in which the beam is focused is controlled electronically, providing means for the direction of focus to be dynamically adjusted.

Radio communication systems are designed to both transmit and receive information contemporaneously. An item of radio communications equipment which is provided with means for both transmission and reception of information is known within the art as a transceiver. The technique of contemporaneous transmission and reception is known as duplexing. Frequency division duplexing is a known duplexing technique in which the carrier frequency of transmitted and received radio signals is arranged to be different and separated by a suitable guard band of frequency. To separate the transmit signal from the received signal, a duplexing filter is required. The duplexing filter operates to prevent energy from the transmitted signal from corrupting the received signal. The duplexing filter must provide sufficient attenuation to a transmitted signal, so that little or no energy from the transmitted signal is present within the frequency band of the received signal.

One disadvantage of conventional planar phased arrays is that a separate duplexing filter is required for each antenna in the array. This increases both cost and size of the antenna system.

A further disadvantage of the planar phased array is that it is only suitable for steering a beam within a limited angle of incidence from a plane perpendicular to the axis in which the antennas are aligned. This is indicated in FIG. 1, where the planar phased array 1 is not suitable for beam steering by a radio signal 9 which has an angle of incidence greater than about sixty degrees from the perpendicular 10. To provide an antenna system with a hemispherical radio coverage pattern, for example, multiple planar phased arrays are required, making construction and testing of an antenna system difficult and further increasing its cost and size.

It is here stated that the term radio coverage where used herein means a volume which an antenna system is capable of illuminating with radio signals or from which an antenna system is capable of detecting radio signals with sufficient strength to effect radio communications.

It is an object of the present invention to provide an antenna system in which the aforementioned disadvantages of known antenna systems using planar phased arrays are eliminated.

SUMMARY OF THE INVENTION

According to the present invention, an antenna system is provided comprising a plurality of antenna units, wherein the antenna units each have at least one substantially flat side hereinafter known as the active side. The antenna units each include a plurality of antennas mounted on the active side to provide a means for transmission or reception, or transmission and reception of radio signals. An antenna system can be constructed from the plurality of antenna units which can provide a desired radio coverage pattern.

As will be appreciated by those skilled in the art, the antenna units provide radio coverage in planes perpendicular to the active side upon which the antennas are mounted. By tessellating several antenna units together at the edges with the active sides at the outermost portion, a phased array may be constructed. This can be arranged, depending upon the number of antenna units and the relative angular offset between their active sides, to provide any desired radio coverage pattern. Furthermore, the antenna system may be constructed and tested in a modular manner.

The antenna system may further include a primary splitter which is connected to a first plurality of antenna units for splitting a signal to be transmitted between the first antenna units, wherein each of the first antenna units connected to the primary splitter includes a secondary splitter. The secondary splitter is connected to a plurality of antennas and to the primary splitter for further splitting the energy of the radio signal to be transmitted between the antennas.

The antenna system may further include a primary combiner connected to a second plurality of antenna units for combining radio signals received therefrom, wherein each of the secondary antenna units connected to the primary combiner includes a secondary combiner. The secondary combiner is connected to a plurality of antennas, and to the primary combiner for combining the energy of radio signals received by the antennas and for feeding the combined received radio signals to the primary combiner.

The antenna units may each include a secondary splitter, and a secondary combiner, providing means for both the transmission and the reception of radio signals via the antennas connected thereto.

The antennas may be paired, and the antenna units may further include, for each antenna pair, a polarization means being operatively connected to the antenna pair with which the polarization means is associated. The polarization means operates to substantially orthogonally polarize the signal to be transmitted by the antenna pair with respect to the radio signal received by the antenna pair.

The polarization means may be a phase displacement device or a branch line coupler. By dividing the energy of the signal to be transmitted between the antenna units and further between each antenna, the amount of energy eventually radiated by each antenna individually is relatively low. A branch line coupler is then used to polarize the transmitted and received radio signals so that they are substantially orthogonal. The branch line couplers operate to provide a 90° (ninety degree) phase displacement between the transmitted and received signals. This orthogonal polarization of the transmitted and received signals provides means for duplex transmission and reception without the need for a duplexing filter, substantially reducing the expense of the antenna system.

The antenna units may further include for each antenna pair mounted thereon, a transmit phase shifter. The transmit phase shifter is connected to the secondary splitter and to the polarization means of the antenna pair with which the transmit phase shifter is associated for displacing the phase of a version of the radio signal to be transmitted by a predetermined amount.

The antenna units may also further include for each antenna pair mounted thereon, a receive phase shifter. The receive phase shifter is connected to the polarization means of the antenna pair with which the receive phase shifter is associated and to the secondary combiner, for displacing the phase of a version of the radio signal by a predetermined amount.

The phase displacement introduced by the transmit phase shifter may be adjustable, whereby the predetermined phase displacement in the version of the radio signal to be transmitted may be dynamically altered.

The phase displacement introduced by the receive phase shifter may also be adjustable whereby the predetermined phase displacement in the version of the received signal may be dynamically altered.

The antenna system may further comprise a beam forming controller means which is connected to the transmit phase shifters, for adjusting the phase displacement which the transmit the phase shifters introduce into the versions of the radio signal to be transmitted. Thus, the energy in the transmitted radio signal fed to the antenna system may be focused into a beam directed in a predetermined direction.

The beam forming controller may further be connected to the receive phase shifters, for adjusting the phase displacement which receive phase shifters introduce into the versions of the received radio signal. Thus the energy of the received radio signal is optimized for detecting the radio signal from a predetermined direction.

Each antenna pair has a controllable transmit phase shifter and receive phase shifter which operate to alter the phase of each version of the transmitted and received radio signal, respectively. The beam forming controller operates to adjust the phase displacement of each version of the transmitted and received signals, providing the antenna system with a means for directional beam forming. A radio communication system in which the antenna system is incorporated, is thereby provided with a means for optimizing the energy of a radio signal transmitted in or received from a corresponding entity which is a known direction.

The antenna unit may further comprise, for each antenna pair, a power amplifier operatively associated therewith, being connected to the transmit phase shifter and to the polarization means for amplifying the radio signal to be transmitted.

The antenna units may further comprise, for each antenna pair a low noise amplifier operatively associated therewith.

The low noise amplifier is connected to the polarization means and to the receive phase shifter for amplifying the received radio signal.

The antenna unit may further include another substantially flat side which is obverse to the active side whereon components are mounted, this side is hereinafter referred to as the component side.

Conductors connecting components mounted on the component side may be formed of a plurality of layers of conducting material disposed between the active and the component sides, wherein the conducting layers are separated from each other by a layer of insulating material.

The connection of the components mounted on the component side to the conducting layers and to the antennas mounted on the active side may be made by conducting vias fabricated into the insulating and conducting layers. The antenna pairs which are mounted on the antenna units may comprise a first and a second dipole. The dipoles may be straight dipoles or crossed dipoles.

A plan view surface of the active side of the antenna units may be substantially triangular in shape. The antenna system may be comprised of five antenna units joined together so as to form a pentagonal body. The term pentagonal body is hereby stated to mean a five sided three-dimensional body, the base of which body forms a pentagon in a plane on which the body rests. Alternatively, the antenna system may be comprised of six of the pentagonal bodies which are joined at the edges to form a thirty-sided polyhedron which provides the antenna system with substantially hemispherical coverage.

A radio communication system may be comprised of an antenna system as described above and a navigation means being connected to the beam forming controller of the antenna system. The navigation means tracks the movement of a target radio communications unit with which radio communications is desired. The navigation system operates depending upon the relative movement of the target radio unit, to adjust in conjunction with the beam forming controller the direction of a transmitted signal and an optimum direction of detection for a received signal.

According to another aspect of the present invention, a method for performing duplex radio communications with directional beam forming is disclosed. The method comprises splitting a radio signal to be transmitted into a plurality of versions, adjusting the phase of each version of the signal to be transmitted so that the total energy of the transmitted signal is focused into a beam pointing in a desired direction, orthogonally polarizing each version of the radio signal to be transmitted with respect to and in correspondence with each version of a received signal, and adjusting the phase of each version of the receive signal so that when the versions of the receive signal are combined, the versions of the received signal add constructively.

An embodiment of the present invention will be described by way of example with reference to the accompanying drawings in which:

DETAILED DESCRIPTION OF THE PRESENTLY PREFERRED EMBODIMENTS

Figure 1:
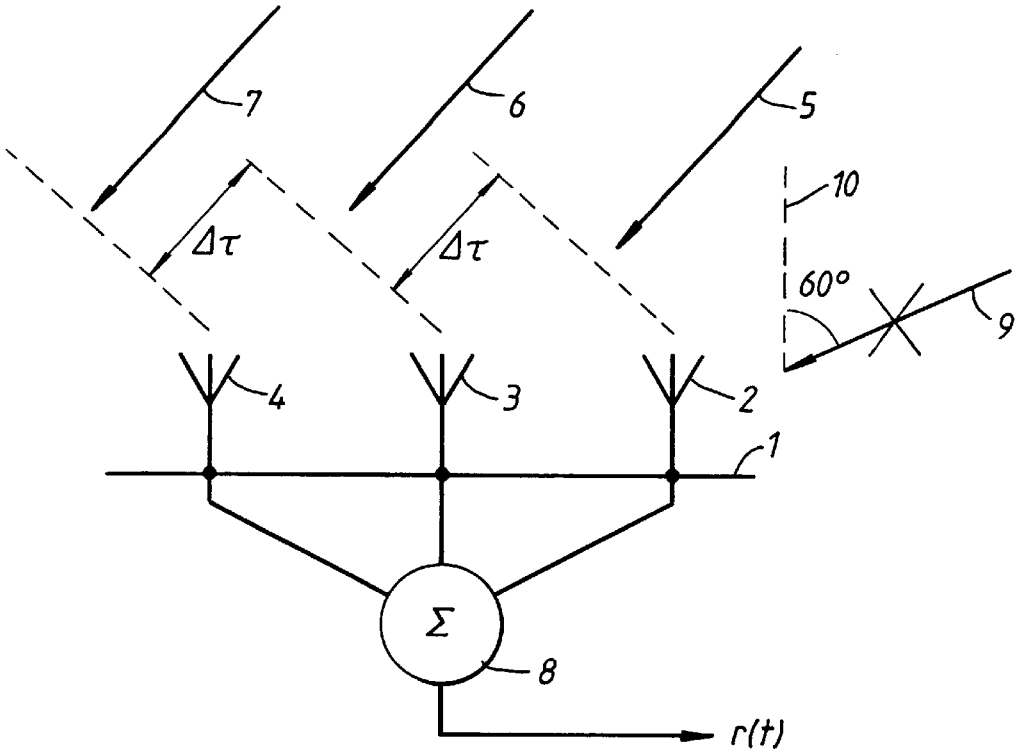
FIG. 1 illustrates a phased array antenna.
Figure 2:
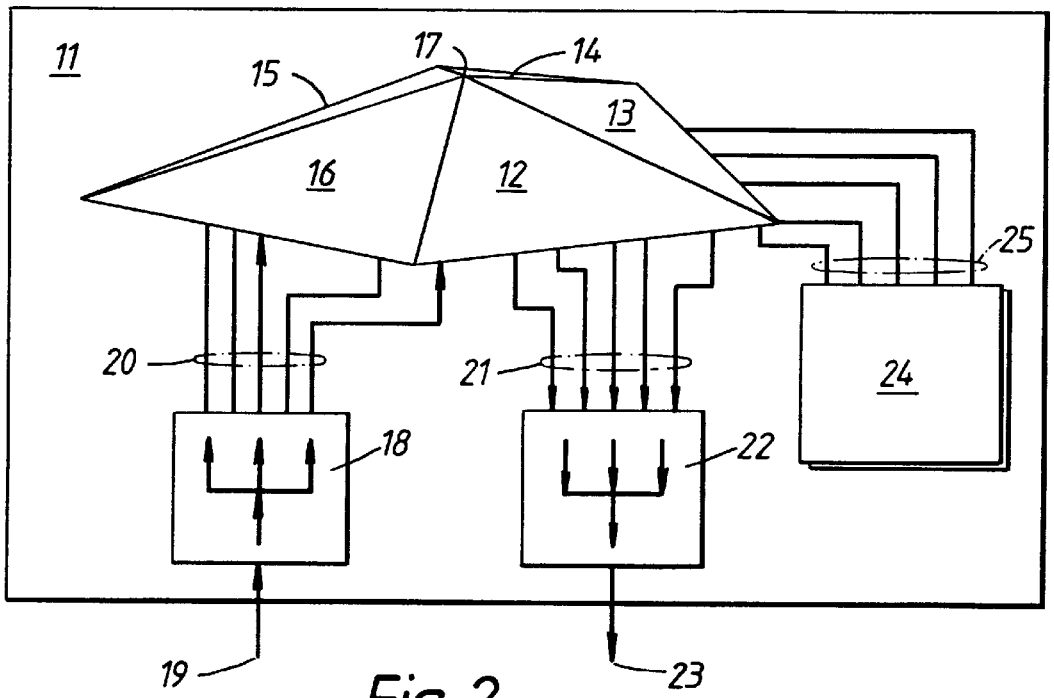
FIG. 2 is a schematic block diagram of an antenna system comprised of five antenna units.

An example of an antenna system 11, is shown in FIG. 2. The antenna system 11, is comprised of five antenna units 12, 13, 14, 15, 16. Each antenna unit is substantially triangular in shape. The antenna units are joined at the edges to form a pentagonal body. The central point 17, where the apex of each triangular antenna units meets, is raised with respect to the opposite sides so that the active side of each triangular antenna unit 12, 13, 14, 15, 16 provides radio coverage in a different direction. The antenna units 12, 13, 14, 15, 16 are intended to be functionally identical to each other. Also shown in FIG. 2, is a primary splitter 18. A radio signal to be transmitted is fed to the primary splitter 18, from a terminal 19. The primary splitter 18 splits the energy of the signal to be transmitted into a number of versions which have equal energy. Each version of the signal to be transmitted is fed to a separate antenna unit via the conductors 20.

As well as transmitting radio signals, each of the antenna units 12, 13, 14, 15, 16, operates to receive radio signals. The radio signals are fed from each antenna unit 12, 13, 14, 15, 16, by a set of conductors 21 to a primary combiner 22. The primary combiner 22 operates to sum the versions of the received signal in order to produce a signal at a terminal 23 containing the total energy of the radio signal received by the antenna system 11.

A beam forming means 24 is also shown in FIG. 2, to be connected to each of the antenna units 12, 13, 14, 15, 16, by a set of conductors 25. The operation of the beam forming controller will be described below.

Figure 3:
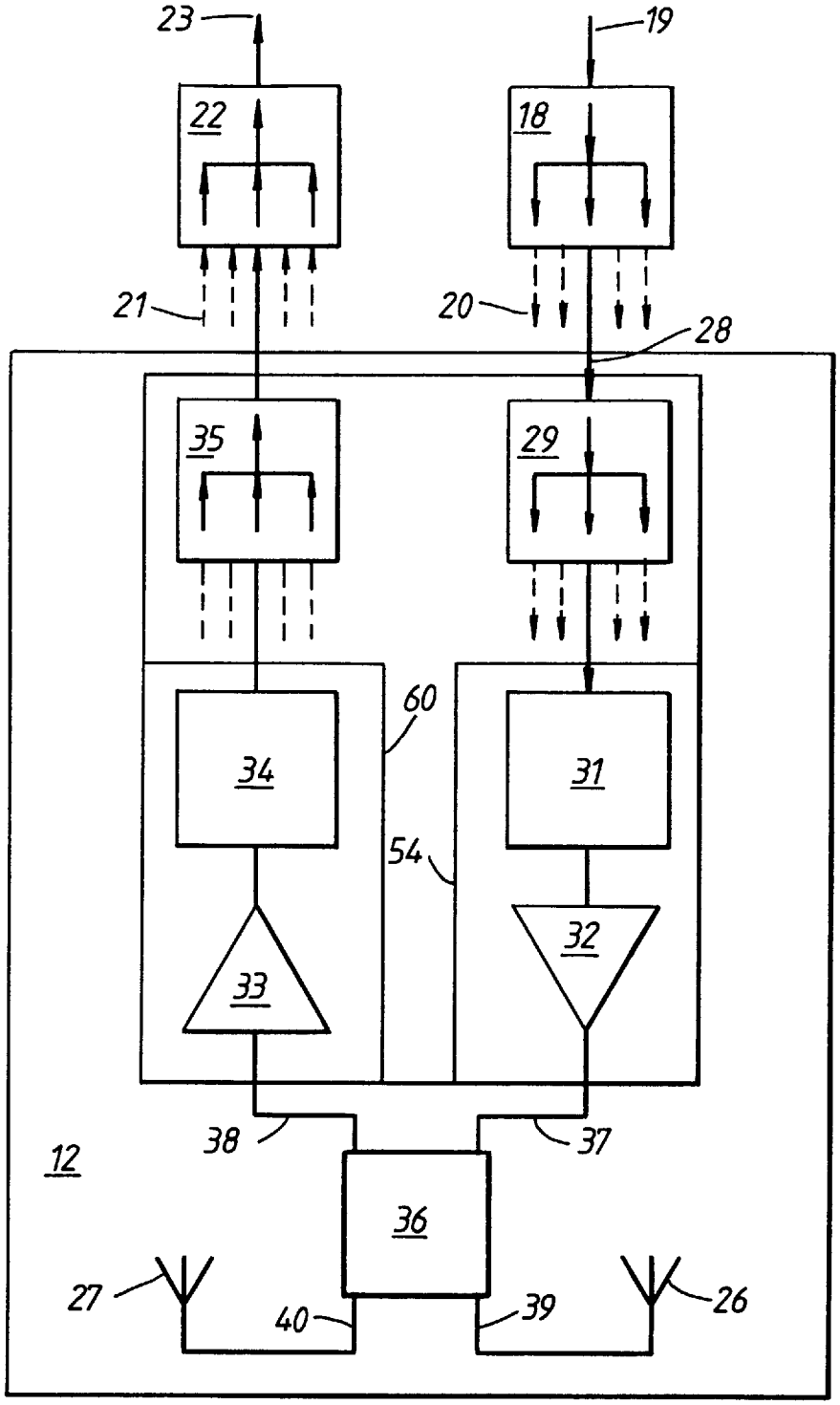
FIG. 3 is a schematic block diagram of an antenna unit.
Figure 5A:
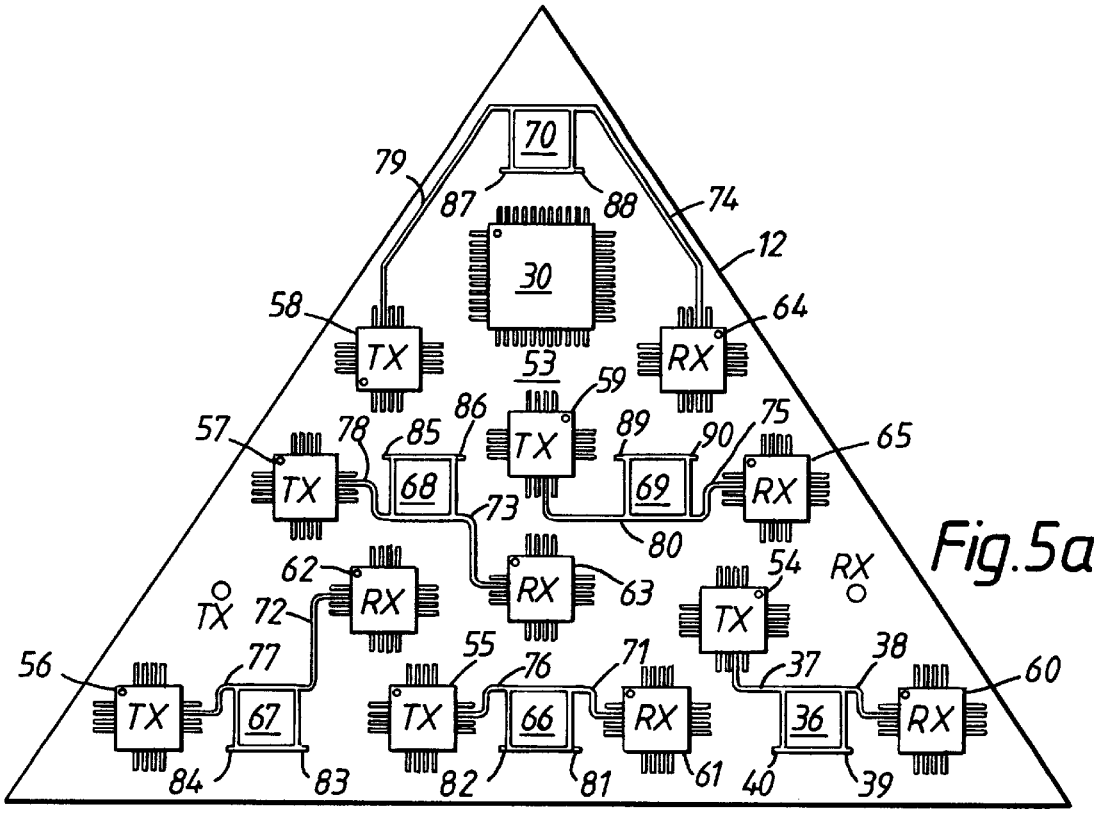
FIG. 5*a* is a plan view of a component side of the antenna unit shown in FIGS. 2 and 3.

A circuit block diagram which illustrates the functional units used in the transmission and reception of radio signals by the antenna system 11 is shown in FIG. 3. In FIG. 3, the primary splitter 18 which also appears in FIG. 2, splits the signal to be transmitted between the antenna units 12, 13, 14, 15, 16. In FIG. 3, only the functional units associated with a single antenna pair 26, 27, of a single antenna unit 12, which also appears in FIG. 2 are shown for the sake of clarity. A subdivided radio signal enters the antenna unit 12, from the primary splitter 18 via a conductor 28, which conveys the signal to be transmitted to a secondary splitter 29. Also shown in FIG. 3, are the transmit phase shifter 31 and power amplifier 32 which form a transmit microwave integrated circuit 54 (MIC) as shown in FIG. 5*a*. Additionally, a low noise amplifier 33 and a receive phase shifter 34 form a receive MIC as shown in FIG. 5*a*. Also, the figure illustrates secondary combiner 35, and a branch line coupler 36. The branch line coupler 36 is fed with the signal to be transmitted by a conductor 37. The branch line coupler 36 feeds a received signal to the low noise amplifier 33 via conductor 38. The branch line coupler 36 is also connected to the antenna pair 26, 27 via conductors 39 and 40. The primary combiner is also shown, which is the same as the primary combiner 22, shown in FIG. 2.

Figure 4:
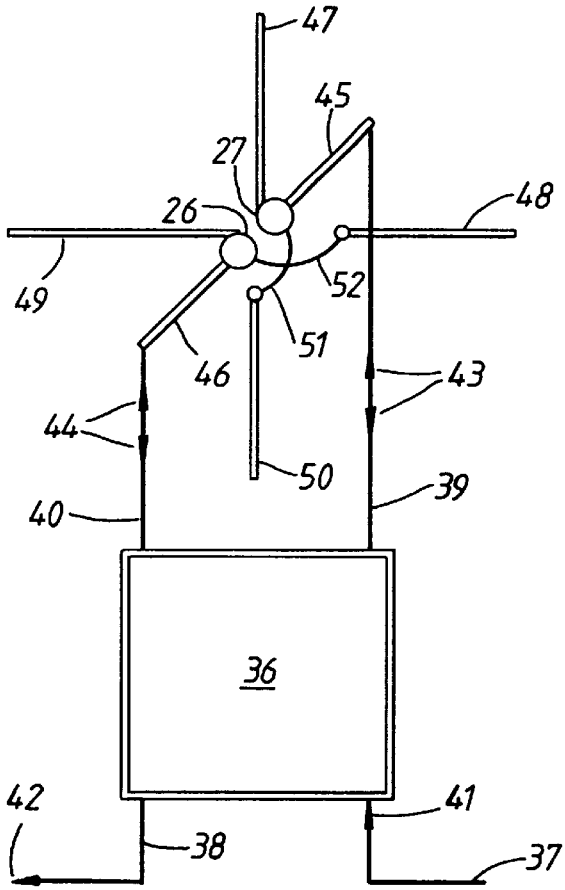
FIG. 4 illustrates an embodiment of the antenna pair shown in FIG. 3.

Six pairs of antennas are mounted on the active side of each antenna unit 12, 13, 14, 15, 16. An example of an embodiment of an antenna pair 26, 27 is shown in FIG. 4. In FIG. 4, the construction of the antenna pair 26, 27 is shown connected to the branch line 36, via the conductors 39, 40.

A signal to be transmitted is fed to the branch line coupler 36, via the conductor 37 as indicated by the arrow 41. Similarly, the received signal is fed from the branch line coupler 36 as indicated by the arrow 42. The branch line coupler 36 operates to circularly polarize both the signal to be transmitted and the received signal but in opposite directions. The signal to be transmitted is fed to the antenna pair 26, 27 via the conductors 39, 40 and the received signal is fed from the antenna pair 26, 27 via the connectors 39, 40 as indicated by the arrows 43, 44.

The antenna pair 26, 27 is embodied as first and second dipoles 26, 27 and further comprises first and second feeders 45, 46 which may be coaxial feeders. The dipoles 26, 27 each comprise two arms 48, 49, 47 and 50 which are fabricated so that they are off-set from each other by an angle of 90°. The polarized signals are conveyed to and from the dipoles 26, 27 via the feeders 45, 46. The unbalanced co-axial feeders 45, 46 may be used with balancing stubs connected to arms 50, 48 to preserve the symmetry of the radiation patterns. The transmitted and received signals are oppositely polarized by virtue of the phase displacement introduced by the branch line coupler 36.

FIG. 5*a* illustrates a plan view representation of the component side 53 of the antenna unit 12 illustrated in FIGS. 2 and 3. Six transmit Microwave Integrated Circuits (MICs) 54, 55, 56, 57, 58, 59, are mounted on the component side 53, which are paired with six receive MICs 60, 61, 62, 63, 64, 65. Respective branch line couplers 36, 66, 67, 68, 69, 70 are associated with each transmit and receive MIC pair. The branch line coupler 36, and the conductors 37, 38, 39, 40 are the same as the ones illustrated in FIGS. 3 and 4. The conductors 39, 40 which connect the branch line coupler 36 to the antenna pair 26, 27 are shown in FIG. 5*a*. These conductors 39, 40 connect the branch line coupler to the antenna pair 26, 27 mounted on the active side, through conductors passing beneath the surface of the component side 53. Similarly, conductors 71, 72, 73, 74, 75 connect the receive MICs 61, 62, 63, 64, 65 to the branch line couplers 66, 67, 68, 69, 70 and the conductors 76, 77, 78, 79, 80 connect the transmit MICs 55, 56, 57, 58, 59 to the branch line couplers 66, 67, 68, 69, 70. Conductors 81, 82, 83, 84, 85, 86, 87, 88, 89, 90 are also partially shown in FIG. 5*a* which connect the branch line couplers to the corresponding antennas on the active side. Integrated circuit 30 acts to process and distribute phase shifting control signals.

Figure 5B:
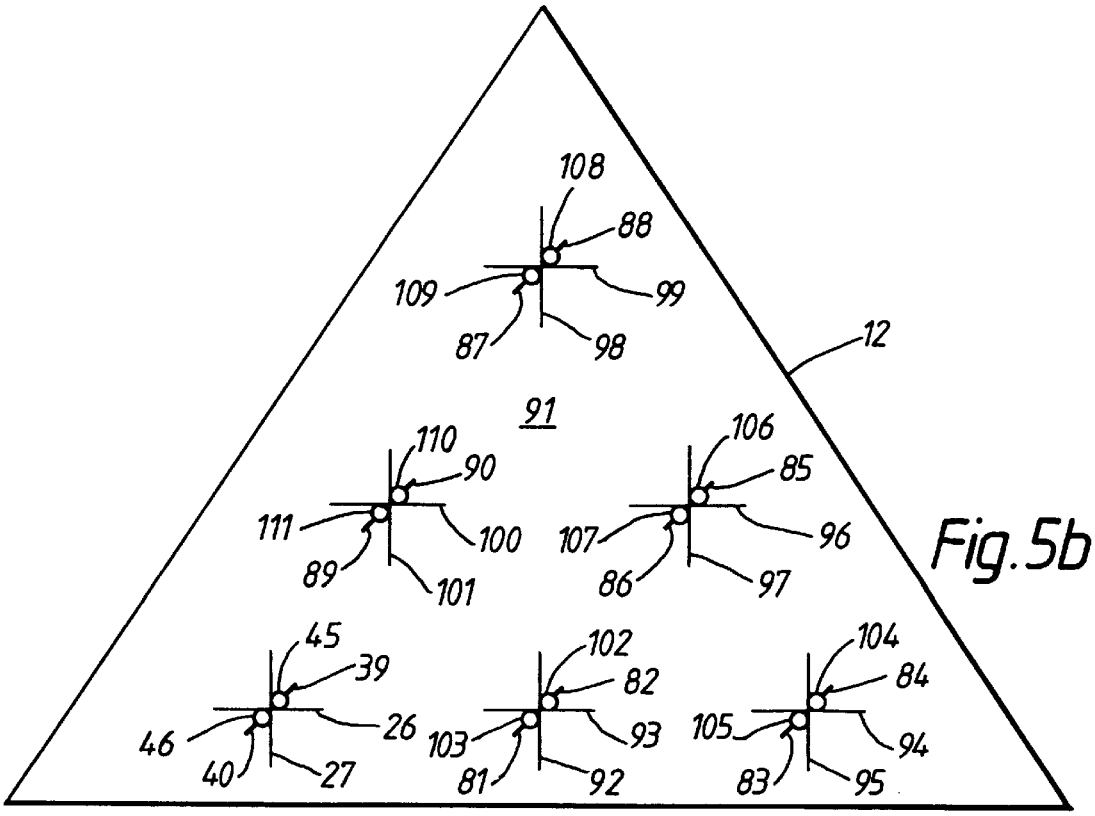
FIG. 5*b* is a plan view illustrating the active side of the antenna unit.

In FIG. 5*b*, the active side 91, of the antenna unit 12, is illustrated and is obverse to the component side 53. Six antenna pairs 26, 27, 92, 93, 94, 95, 96, 97, 98, 99, 100, 101 are mounted on the active side. The antenna pair 26, 27 illustrated in FIG. 5*b* is the same as the one appearing in FIGS. 3 and 4. Conductors 39, 40, 81, 82, 83, 84, 85, 86, 87, 88, 89, 90, are partially shown in FIG. 5*b*. The conductors 39, 40 associated with the antenna pair 26, 27 are the same as those shown in FIG. 4 and partially illustrated in FIG. 5*a*. As shown in FIG. 5*b*, the transmitted and received signals are fed to and from each antenna pair 26, 27, 92, 93, 94, 95, 96, 97, 98, 99, 100, 101 via feeders 45, 46, 102, 103, 104, 105, 106, 107, 108, 109, 110, 111 associated therewith. The feeders 45, 46 are the same as those illustrated in FIG. 4.

Figure 5C:
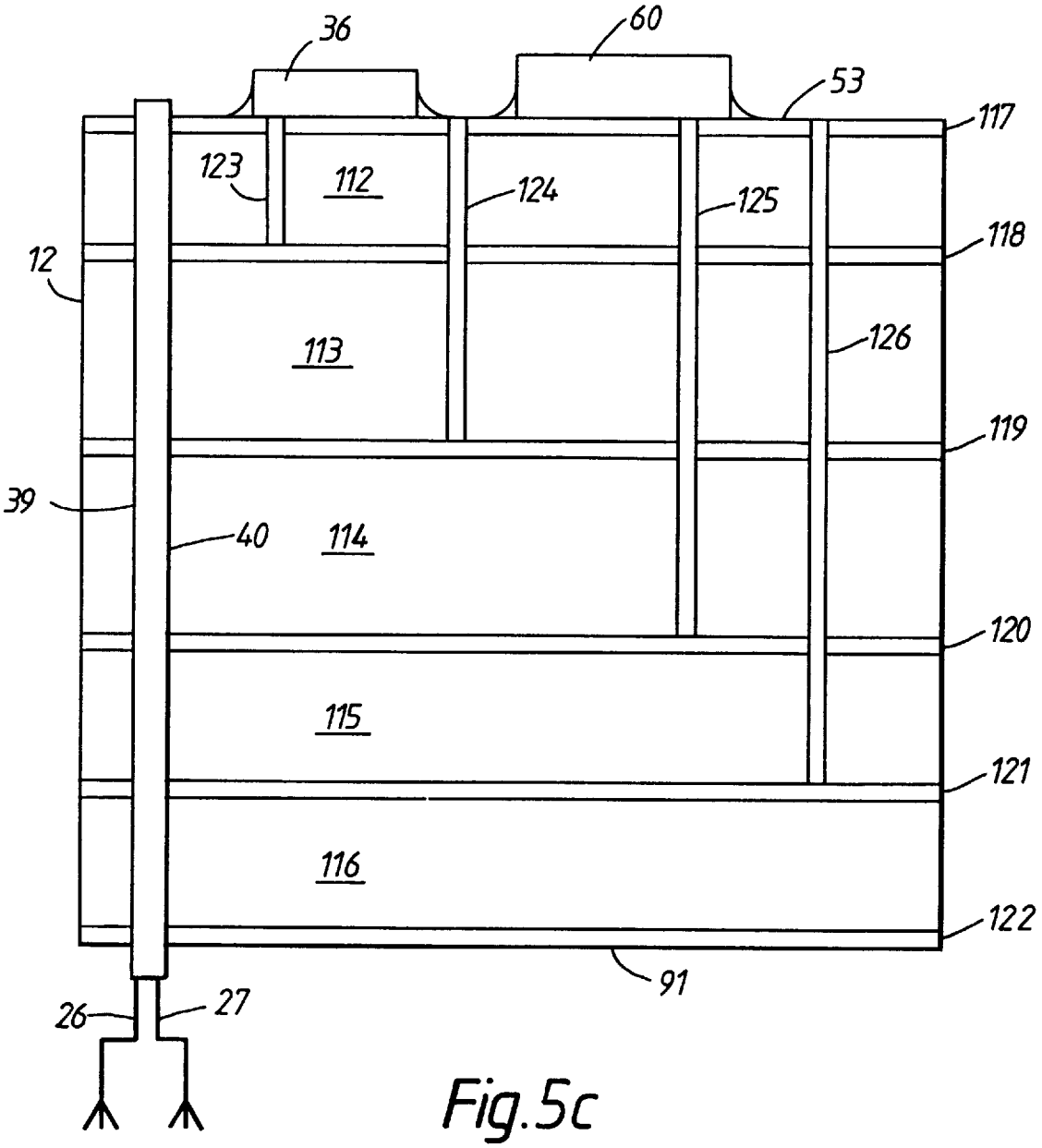
FIG. 5*c* is a cross-section of a exemplary embodiment of the antenna unit.

A schematic diagram of a sample cross section of the antenna unit 12, is shown in FIG. 5*c*. The cross section of the antenna unit 12 shows the branch line coupler 36 and the receiver MIC 60 mounted on the component side 53. The antenna unit 12 is shown to have been fabricated with five insulating layers 112, 113, 114, 115, 116 disposed between the active layer 91 and the component layer 53. Stripline and ground plane layers 117, 118, 119, 120, 121, 122 are also disposed between the component layer 53 and the active layer 91 with one layer between each of the insulating layers 112, 113, 114, 115, 116 and two stripline layers 117, 122 fabricated on the surface of the component layer 53 and the active layer 91 respectively. The stripline layers 117, 118, 119, 120, 121, 122 facilitate interconnection of the components mounted on the component layer 53. The components are connected to the layers 118, 119, 120, 121, disposed between the insulating layers 112, 113, 114, 115, 116 by interconnect vias 123, 124, 125, 126 which pass through the insulating and conducting layers. The antennas mounted on the active side 91 are connected to the branch line couplers mounted on the component side, via coaxial conductor vias. The antenna pair 26, 27 shown schematically in FIG. 5*c* represents the antenna pair 26, 27 also shown in FIGS. 3, 4 and 5*b*. These are shown to be connected to the branch line coupler 36, via coaxial conductors 39, 40 which are the same as the conductors 39, 40 illustrated in FIGS. 3, 4, 5*a* and 5*b*.

In the circuit diagram of the antenna unit 12 shown in FIG. 3, the transmit and receive antenna pair 26, 27 are shown with a branch line coupler 36 which operates to orthogonally polarize the transmitted and receive radio signals, providing a means for duplex operation as previously explained. The radio signal to be transmitted is fed from the secondary splitter 29 to the antennas mounted on the antenna unit 12 via a transmit phase shifter and power amplifier. In the example shown in FIG. 3, the radio signal is fed from the secondary splitter 29, to the antenna pair 26, 27 via the transmit phase shifter 31 and the power amplifier 32.

In the receiver chain, the antenna pair 26, 27 is connected via the branch line coupler 36 to the low noise amplifier 33. The low noise amplifier 33 is connected via the receive phase shifter 34 to the secondary combiner 35. The secondary combiner 35 combines each version of the signal received from each receive MIC 60, 61, 62, 63, 64, 65 mounted on the antenna unit 12. In FIG. 3, only the receive chain associated with the antenna pair 26, 27 is shown as an example. The combined signal is further combined with versions of the signals received by the other antenna units 13, 14, 15, 16 by the primary combiner 22, to produce a combined received signal at the output terminal 23 containing the total energy received by the antenna system 11.

The energy of the signal to be transmitted is divided between each antenna unit within the system and further divided between each of the antenna pairs mounted on each antenna unit. As a result, the energy radiated by each antenna pair individually is relatively small compared with the total energy in the signal. The division of the energy of the signal to be transmitted in this way permits the use of a branch line coupler to provide orthogonal polarization of the transmitted radio signal and the radio signal received by the antenna pairs. It is the division of the energy which permits the use of a branch line coupler without a large and expensive duplexing filter.

The antenna system 11 is provided with a means for beam forming through the operation of the transmit and receive phase shifters and the beam forming controller 24 with which they are connected by the set of connectors 25 as illustrated in FIG. :2. The beam forming controller 24, provides a means for controlling the direction of the transmitted and received signal beams, whereby the signals can be focused at a particular target entity with which radio communications is desired. An example of this can be seen from the signal antenna pair 26, 27 shown in FIG. 3. The transmit phase shifter 31 displaces the phase of the signal to be transmitted by an amount selected by the beam forming controller 24. Similarly the receive phase shifter 34 displaces the phase of the received signal by an amount selected by the beam forming controller 24.

The construction of an antenna system from a number of identical, independently operating antenna units provides the facility for modular construction and testing of an antenna system. Each antenna unit within the system may be tested individually both before and after inclusion within the antenna system. Additionally, an antenna system may be constructed from a number of antenna units, so as to satisfy any desired radio coverage pattern. For example, the present invention has applications in the field of satellite communications. It is a requirement of radio communications ground terminals which are to operate with satellites that the antenna system provides hemispherical radio coverage. Furthermore directional gain through beam forming is required in order to make optimum use of the energy in a transmitted or received signal.

Figure 6A:
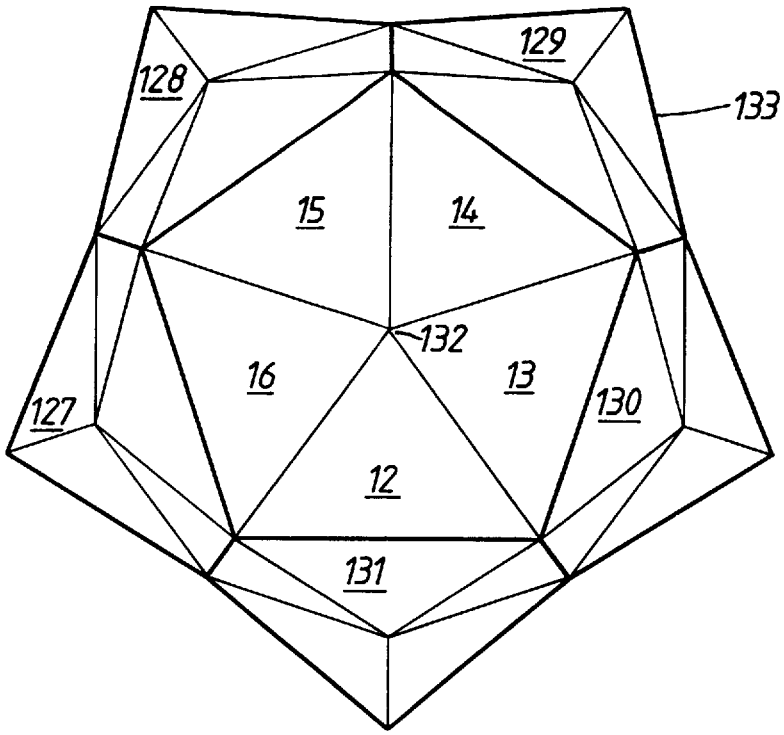
FIG. 6*a* is a plan view of an antenna system comprised of thirty antenna units constructed to form a thirty sided polyhedron.
Figure 6B:
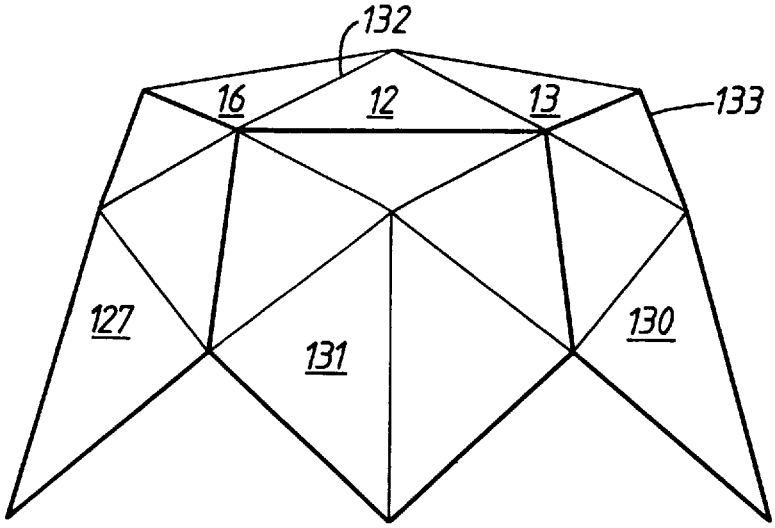
FIG. 6*b* is an elevational view illustrating the antenna system shown in FIG. 6*a;*

An example of an antenna system meeting the requirements for hemispherical coverage is illustrated in FIGS. 6*a* and 6*b*. The antenna system is shown in plan view in FIG. 6*a* and elevation view in FIG. 6*b*. This illustrates the pentagonal body constructed from the five antenna units 12, 13, 14, 15, 16 which are embodied within the antenna system 11 illustrated in FIG. 2. Additionally this figure illustrates five other similar pentagonal bodies 127, 128, 129, 130, 131 which are attached to the first pentagonal body 132 to form a thirty-sided polyhedron. The thirty-sided polyhedron forms the antenna system 133 in FIGS. 6*a* and 6*b* which is approximately a hemisphere. The antenna system 133 is therefore provided with a means for providing hemispherical coverage for radio signals to be transmitted or received.

Figure 7:
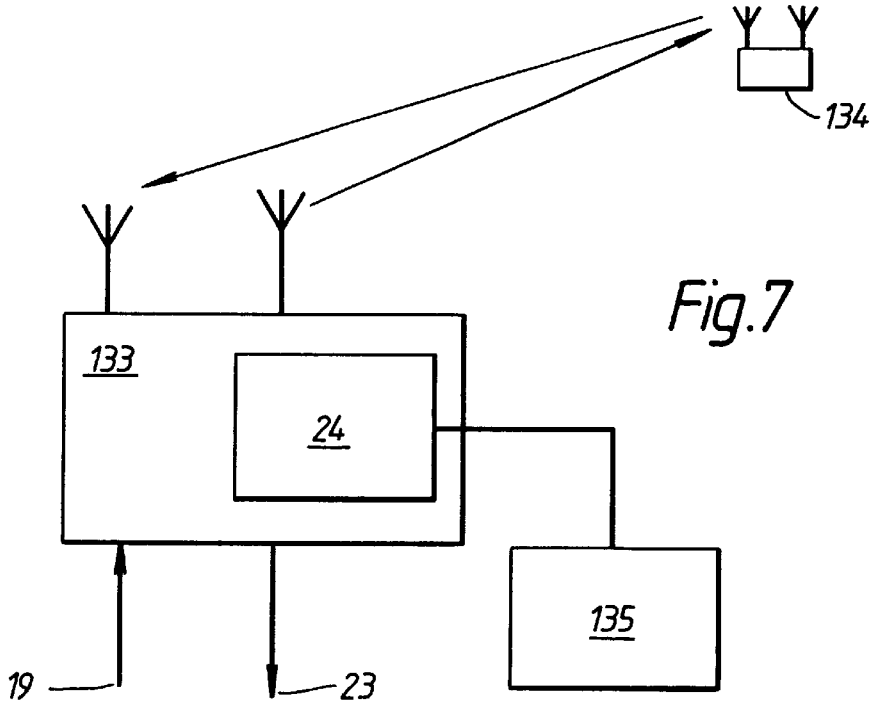
FIG. 7 is a block schematic diagram representing a satellite radio communication system.

A satellite communications system which uses the hemispherical antenna system 133 is shown in FIG. 7. The signal to be transmitted is fed from the transmit terminal 19 which is the same as that shown in FIGS. 2 and 3 to a primary splitter (not shown for the sake of clarity) similar to the primary splitter 18 illustrated in FIG. 2. This splits the signal to be transmitted between each antenna unit within the antenna system 133 in the manner previously described. Similarly the received signal is summed from all antenna units by a primary combiner (not shown for the sake of clarity) similar to the primary combiner 22 to form a signal at the received terminal 23 which is also shown in FIGS. 2 and 3 and which contains the total energy of the radio signal received by the antenna system 133. The position of an entity 134 with which radio communications is desired is determined by a tracking computer 135. This determines the direction in which the radio signals are to be focused. The transmitted or received radio signals are focused into a beam as previously described, by the beam forming controller 24 which is the same as that illustrated in FIG. 2. The tracking computer 135 operates to monitor the relative movement of the target entity 134 with respect to the antenna system 133 and generates appropriate signals to cause the beam forming controller 24 to adjust the direction of focus for the radio signals.

Although the present invention has been described for application to a satellite communications system to provide hemispherical radio coverage, it will be understood by those skilled in the art that the antenna units may be formed into an antenna system providing any desired radio coverage pattern.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

What we claim is:

1. An antenna system comprising:

a plurality of antenna units for duplex transmission and reception of signals;

the antenna units each further comprised of at least one substantially flat active side having a plurality of antennas mounted thereon to provide for transmission or reception of radio communication signals in a desired coverage pattern;

a primary splitter connected to the plurality of antenna units for splitting a signal to be transmitted between the antenna units, each of said antenna units connected to the primary splitter further comprising a secondary splitter, the secondary splitter connected to a first group of the plurality of antennas and to the primary splitter for further splitting energy of radio signals to be transmitted;

a primary combiner connected to the plurality of antenna units for combining radio signals received therefrom, each of the plurality of antenna units connected to the primary combiner further comprising a secondary combiner, the secondary combiner being connected to a second group of the plurality of antennas and to the primary combiner for combining energy of radio signals received by the second group of antennas and for feeding the combined received radio signal to said primary combiner;

wherein members from the first and second groups of the plurality of antennas are further grouped in pairs, and the antenna units further comprising, for each antenna pair, a polarization means connected to the antenna pair with which the polarization means is associated, and the polarization means substantially orthogonally polarizes a signal to be transmitted by the antenna pair with respect to a signal received by the antenna pair;

a plan view of a surface of the active side of the antenna unit is substantially triangular is shape thereby allowing for a plurality of antenna units to be arranged in a manner so as to conform to a substantially spherical shape;

and the antenna units operate together to form a single beam which is electronically steerable over a full hemisphere thereby providing a substantially hemispherical coverage pattern.

2. The antenna system of claim 1, further comprising five substantially triangular in shape antenna units joined together to form a pentagonal body which is shaped so as to conform to a substantially spherical shape.

3. The antenna system of claim 1, wherein a plurality of the pentagonal bodies are joined at edges to form a thirty-sided polyhedron to provide substantially hemispherical radio coverage.

4. The antenna system of claim 1, wherein the antenna system is a radio telecommunication antenna system.

5. The antenna system of claim 1, wherein the antenna units operate together to form a single beam and the orthogonal polarization of the transmitted and received signals enables duplex transmission and reception of signals without a duplexing filter.

6. The antenna system of claim 1, wherein the polarization means is a phase displacement device.

7. The antenna system of claim 1, wherein the polarization means is a branch line coupler.

8. The antenna system of claim 1, wherein the plurality of antenna units include for each antenna pair mounted thereon, a transmit phase shifter connected to the secondary splitter and to the polarization means of the antenna pair with which the transmit phase shifter is associated for displacing a phase of a version of the radio signal to be transmitted.

9. The antenna system of claim 1, wherein the plurality of antenna units include for each antenna pair mounted thereon, a receive phase shifter connected to the polarization means of the antenna pair with which the receive phase shifter is associated and to the secondary combiner, for displacing a phase of the version of the received radio signal.

10. The antenna system of claim 8, wherein the phase displacement introduced by the transmit phase shifter is adjustable to provide dynamic adjustment of phase displacement.

11. The antenna system of claim 9, wherein the phase displacement introduced by the received antenna phase shifter is adjustable to provide dynamic adjustment of phase displacement.

12. The antenna system of claim 10, further comprising a beam forming controller connected to the transmit phase shifters for adjusting a phase displacement which the transmit phase shifters introduce into versions of a radio signal to be transmitted by the antenna pairs with which the transmit phase shifters are associated.

13. The antenna system of claim 12, wherein the beam forming controller is connected to the receive phase shifters, for adjusting the phase displacement which receive phase shifters introduce into versions of the radio signal received by the antenna pairs with which the received phase shifters are associated.

14. The antenna system of claim 8, wherein the antenna units comprise, for each antenna pair, a power amplifier connected to the transmit phase shifter and to the polarization means.

15. The antenna system of claim 9, wherein the antenna units each comprise, for each antenna pair, a low-noise amplifier connected to the polarization means and to the receive phase shifter.

16. The antenna system of claim 1, wherein the antenna units comprise a further substantially flat component side obverse to the active side wherein components are mounted.

17. The antenna system of claim 16, wherein the antenna units comprise a plurality of layers of conducting material disposed between the active and the complement sides, wherein the conducting layers are separated from each other by a layer of insulating material.

18. The antenna system of claim 17, wherein the components mounted on the component side of the antenna units are connected to the antennas mounted on the active side by conductive vias located within the insulating and conducting layers.

19. The antenna system of claim 1, wherein the antenna pairs comprise a first and second dipole.

20. The antenna system of claim 19, wherein the dipoles are straight dipoles.

21. The antenna system of claim 20, wherein the dipoles are crossed dipoles.

* * * * *